US011597593B1

(12) United States Patent
Schilling et al.

(10) Patent No.: US 11,597,593 B1
(45) Date of Patent: Mar. 7, 2023

(54) CONTAINMENT BAG WITH SELF-SUPPORTING SIDEWALLS

(71) Applicant: PacTec, Inc., Clinton, LA (US)

(72) Inventors: Michael R. Schilling, Clinton, LA (US); Troy Town, Clinton, LA (US)

(73) Assignee: PacTec, Inc., Clinton, LA (US)

( * ) Notice: Subject to any disclaimer, the term of this patent is extended or adjusted under 35 U.S.C. 154(b) by 276 days.

(21) Appl. No.: 16/926,952

(22) Filed: Jul. 13, 2020

Related U.S. Application Data

(60) Provisional application No. 62/875,252, filed on Jul. 17, 2019.

(51) Int. Cl.
*B65F 1/00* (2006.01)
*B65F 1/08* (2006.01)
*B65F 1/14* (2006.01)

(52) U.S. Cl.
CPC ..... *B65F 1/002* (2013.01); *B65F 1/085* (2013.01); *B65F 1/1452* (2013.01); *B65F 2220/1063* (2013.01); *B65F 2220/124* (2013.01); *B65F 2250/1143* (2013.01); *B65F 2250/1146* (2013.01)

(58) Field of Classification Search
CPC ..... B65D 33/00; B65D 31/00; B65D 25/28; B65D 5/606; B65D 2563/00; B65D 2501/24496; B65D 90/048; B65D 88/1637; B65F 2003/0246; B65F 1/002; B65F 1/085; B65F 1/1452; B65F 2220/1063; B65F 2220/124; B65F 2250/1143; B65F 2250/1146
See application file for complete search history.

(56) References Cited

U.S. PATENT DOCUMENTS 4,679,242 A * 7/1987 Brockhaus ..... A45C 7/0059 383/18
7,073,676 B1 7/2006 Town
7,437,784 B1 * 10/2008 Turnipseed ..... B65D 29/02 383/18
7,845,511 B1 12/2010 Strickland et al.
7,861,880 B2 * 1/2011 Britt ..... B65D 88/1687 220/666
8,191,722 B1 6/2012 Town
(Continued)

FOREIGN PATENT DOCUMENTS

GB 2453305 B 2/2012

OTHER PUBLICATIONS

Questar "Galaxy Waste Container" retrieved from http://questarusa.com/hazardous-waste-packaging/flexible-un-rated-containers/galaxy-waste-container/ on Jun. 25, 2018.
(Continued)

*Primary Examiner* — Kareen K Thomas
(74) *Attorney, Agent, or Firm* — Jones Walker LLP

(57) ABSTRACT

A self-standing container having four sidewall panels, a bottom panel, and openable top panel, wherein (i) all the panels are formed of a polymer material, and (ii) the top panel has a closure configured to close the top panel in relation to the sidewall panels. Each sidewall panel has a pocket panel attached thereto forming a pocket. A spring steel stiffener is positioned between each sidewall and pocket panel, with the spring steel stiffener forming a closed loop.

19 Claims, 5 Drawing Sheets

(56) References Cited

U.S. PATENT DOCUMENTS

| | | | | |
|---|---|---|---|---|
| 8,459,710 | B1 * | 6/2013 | White | B65G 7/12 294/152 |
| 8,499,953 | B1 | 8/2013 | Town | |
| 8,562,212 | B1 | 10/2013 | Strickland et al. | |
| 8,777,034 | B1 | 7/2014 | Town | |
| 8,894,281 | B2 | 11/2014 | Town et al. | |
| 8,894,282 | B2 | 11/2014 | Town et al. | |
| 9,056,710 | B1 | 6/2015 | Strickland et al. | |
| 9,365,345 | B2 | 6/2016 | Town et al. | |
| 9,478,322 | B1 | 10/2016 | Schilling et al. | |
| 9,493,299 | B2 | 11/2016 | Town et al. | |
| 9,679,669 | B2 | 6/2017 | Schilling et al. | |
| 2003/0216607 | A1 * | 11/2003 | Lindgren | B65F 1/0006 588/249.5 |
| 2015/0314956 | A1 * | 11/2015 | Clevenger | B30B 9/3053 220/9.1 |
| 2015/0344182 | A1 * | 12/2015 | Malin | B65D 85/18 220/528 |
| 2020/0118700 | A1 * | 4/2020 | Schilling | G21F 5/005 |

OTHER PUBLICATIONS

Clean Earth Systems, Inc. "Clean-Pak Flap Top" retrieved from https://cleanearthsystems.com/product/clean-pak-flap-top/ on Jun. 25, 2018.

Bags constructed with a cardboard insert as disclosed in U.S. Appl. No. 15/680,398 were on sale in the United States prior to Jul. 2018.

* cited by examiner

CONTAINMENT BAG WITH SELF-SUPPORTING SIDEWALLS

CROSS REFERENCE TO RELATED APPLICATION

This application claims the priority benefit under USC § 119 to U.S. Provisional Application No. 62/875,252, filed on Jul. 17, 2019, which is incorporated by reference herein in its entirety.

BACKGROUND

In the waste disposal industry, various types of containers are utilized to store waste. For various types of waste, including hazardous waste, polymeric liners are utilized to encapsulate the waste inside a container or enclosure. For large scale projects, a rigid waste container, such as a metal container, may be used, and a flexible liner may be positioned in the container to protect the container and to enclose the waste for disposal. In smaller scale projects, a rigid container may not be justified. In such projects, a free-standing, self-supporting flexible container is more practical. It typically is preferable that such containers be flexible until put in use, so that the containers can be easily folded, stored and shipped.

Prior art flexible, self-supporting disposal containers included synthetic material bags, such as polypropylene bags, wherein the bag sidewalls included pockets in which semi-rigid planar materials, such as cardboard sheets, could be inserted. The cardboard sheets provided the needed degree of rigidity to the bag sidewalls to allow the bag to be self-supporting. Because the enclosures were likely exposed to external environmental conditions, such as rain, the cardboard materials could become saturated with water and collapse, and the container would then cease to be self-supporting and create storage and transportation issues, particularly for hazardous wastes.

Summary of Selected Embodiments of Invention

One embodiment of the invention is a self-standing container having four sidewall panels, a bottom panel, and openable top panel, wherein (i) all the panels are formed of a polymer material, and (ii) the top panel has a closure configured to close the top panel in relation to the sidewall panels. Each sidewall panel has a pocket panel attached thereto forming a pocket. A spring steel stiffener is positioned between each sidewall and pocket panel, with the spring steel stiffener forming a closed loop.

DETAILED DESCRIPTION OF SELECTED EMBODIMENTS

Figure 1:
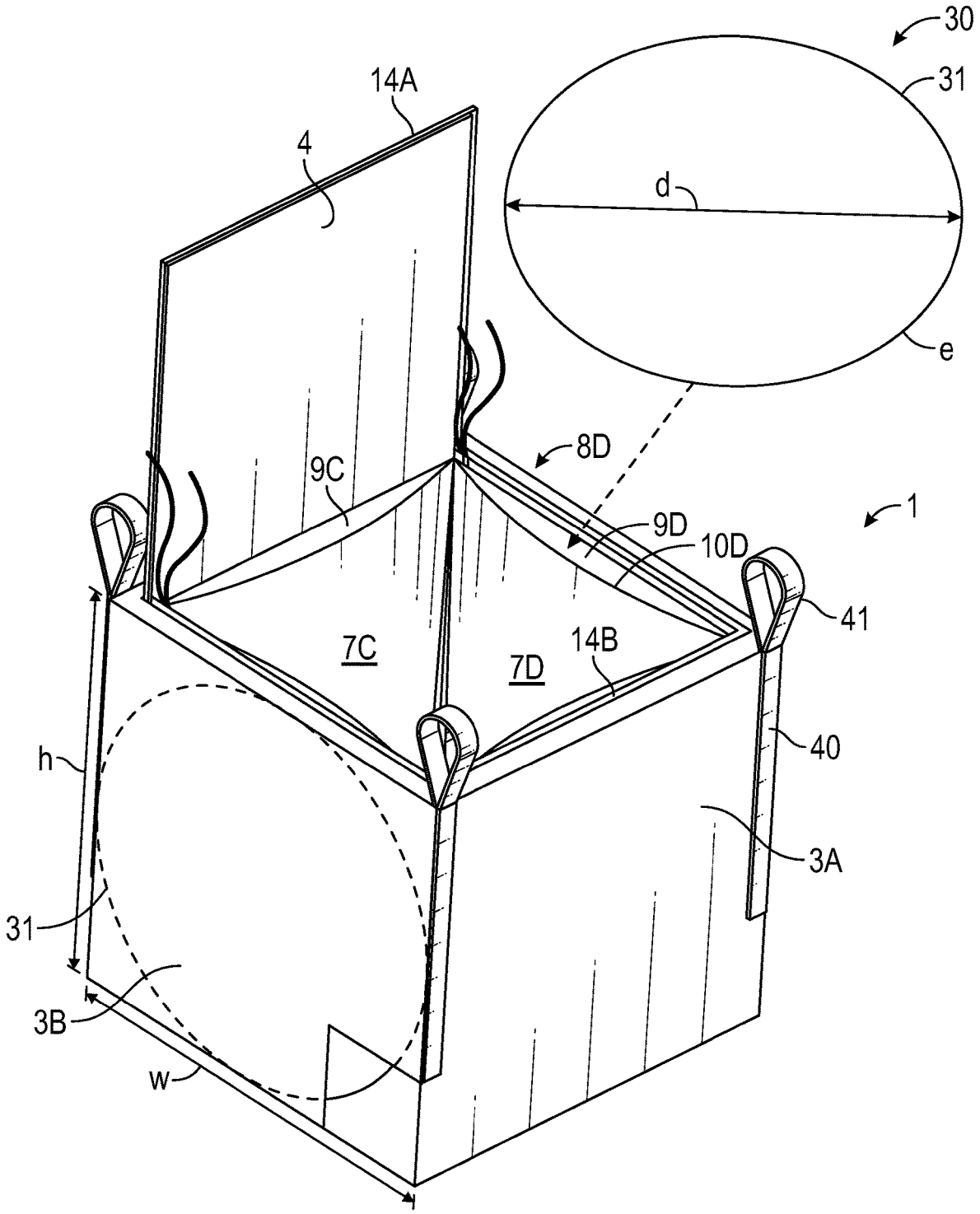
FIG. 1 illustrates a perspective view of a first embodiment of the container of the present invention.

FIG. 1 shows one embodiment of the present invention, a containment bag 1 with self-supporting sidewalls (also referred to more generically as a "self-standing container"). Most generally, containment bag 1 comprises a series of sidewalls 3, a bottom panel 5 (hidden from view in the Figures), and a top panel 4. The FIG. 1 containment bag is illustrated as having four sidewalls 3, with the sidewalls being rectangular (e.g., square) and sidewalls 3A and 3B being visible in the Figure. The width "w" and height "h" of the sidewalls 3 could vary substantially depending on ultimate intended us of containment bag 1, e.g., as small as 12"×12" up to 5'×5', but of course, there could also be embodiments with smaller or larger sidewall dimensions. The containment bag need not have four sidewalls, but could have three sidewalls or more than four sidewalls. Similarly, the containment bag could conceivably have a round continuous sidewall, i.e., the containment bag is basically in the shape of a cylinder. Nor does a "panel" need to be a discrete or separate section of material, but multiple panels could be formed by a continuous section of material demarcated into discrete "panels" by folding, sewing, etc. All such variations should be considered within the scope of the present invention.

The containment bag "top" or "top panel" 4 is shown as attached to the bag along one sidewall 2 and includes a "closure" means or mechanism 14 allowing top panel 4 to close in relation to the sidewall panels, e.g., to enclose the interior volume of the containment bag. Although closure 14 is shown in the Figures as a zipper device (e.g., a #10 coil nylon or polyester zipper), alternative embodiments of closure 14 might include a velcro closure, a tie strap closure, or any other conventional or future developed closure mechanism. In the illustrated embodiments, the zipper is shown formed completely within top panel 4, i.e., there is a portion of the top panel between the sidewall panels and the top panel. However, in other embodiments, the zipper may form all or part of the connection between the top panel and the sidewall panels. Alternatively, the zipper could be positioned along the upper portion of the sidewall panels and the top panel is attached to this upper portion of the sidewall panels. Still further, the top of the container could be extensions of the sidewalls which zip together and then be pulled down flat, leaving two triangular folds which can be folded flat as shown in FIG. 6 of U.S. Ser. No. 15/680,398 filed Aug. 18, 2017, which is incorporated by reference.

Although the walls, top and bottom of containment bag 1 could be formed of any material suitable for the bag's intended use, certain preferred embodiments will utilize materials such as woven polypropylene (WPP), woven polyethylene (WPE), polyvinyl chloride (PVC), urethane, non-woven polypropylene (NWPP), non-woven polyethylene (NWPE), non-woven polyester (NWPET), coated NWPP (Ctd NWPP), and coated NWPET (Ctd NWPET). The thickness of these materials when used as bag walls will typically range between about 5 and about 20 oz/yd$^2$ (or any sub-range in between), but particular embodiments could have a thickness outside of this range. When coated, the coating may be formed of a thin film of polymer material (e.g., a 3 ml layer of polyethylene) applied to the surface of the main polymer fabric forming the panels.

Figure 2:
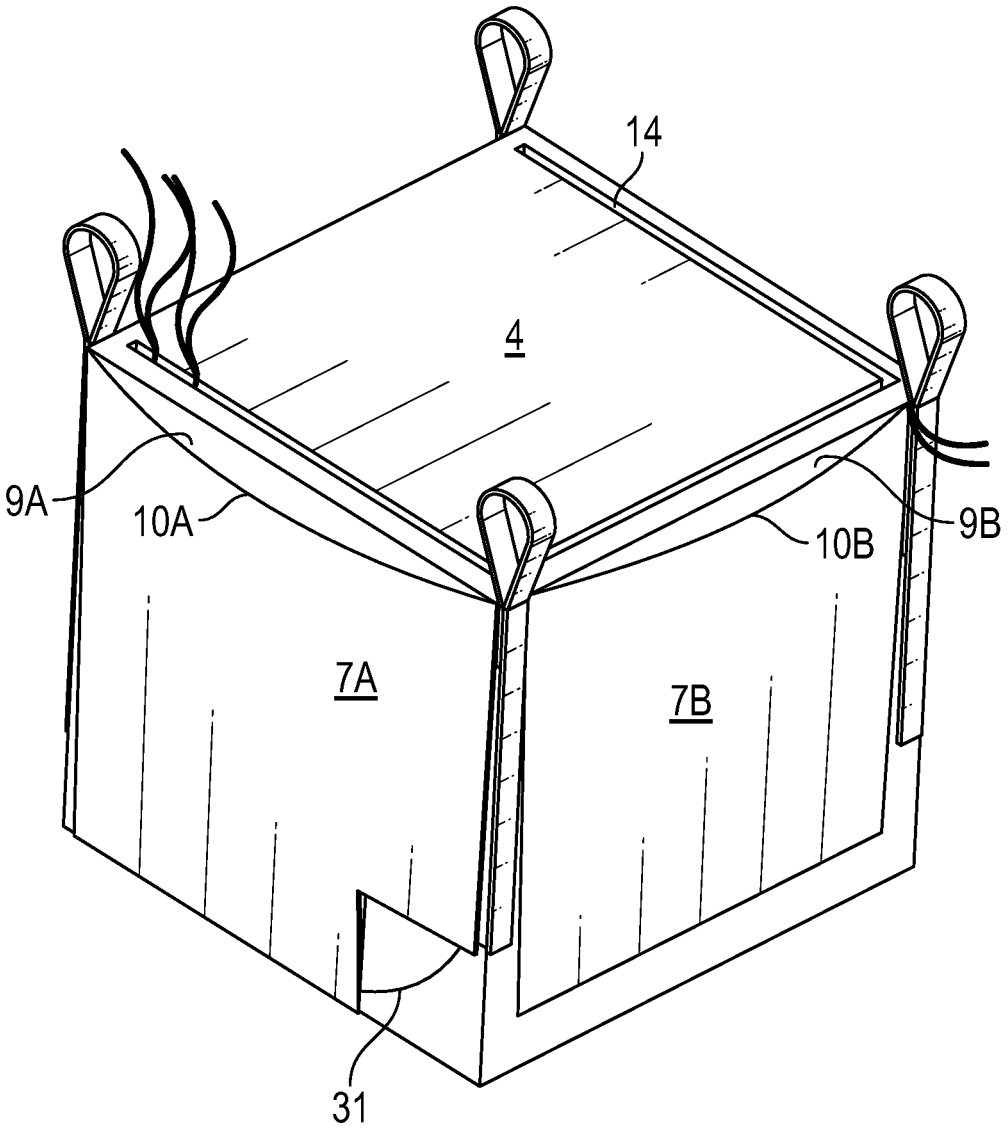
FIG. 2 illustrates a second embodiment of the container with the top panel closed.
Figure 3:
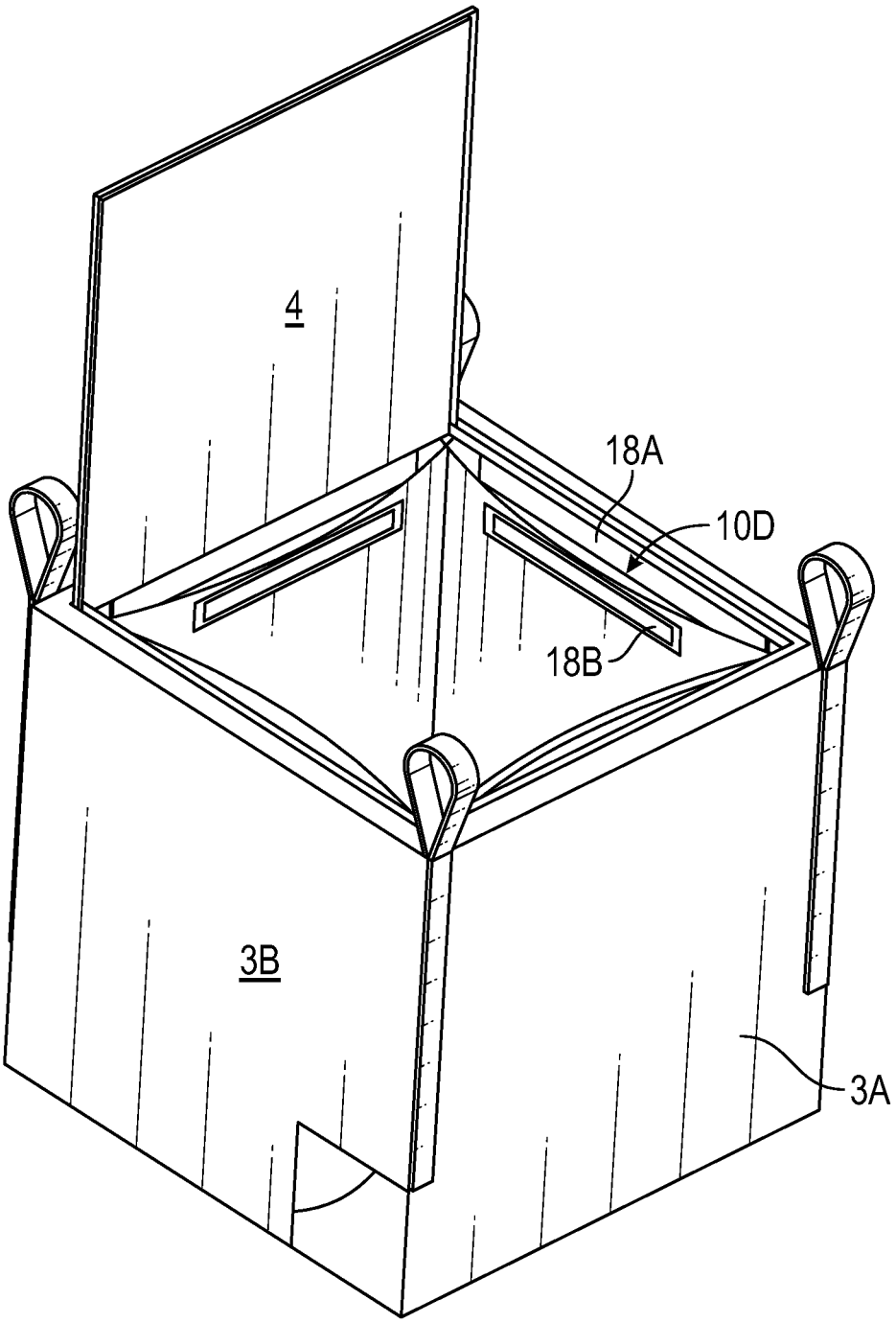
FIG. 3 illustrates a perspective view of a third embodiment of the container of the present invention.
Figure 4:
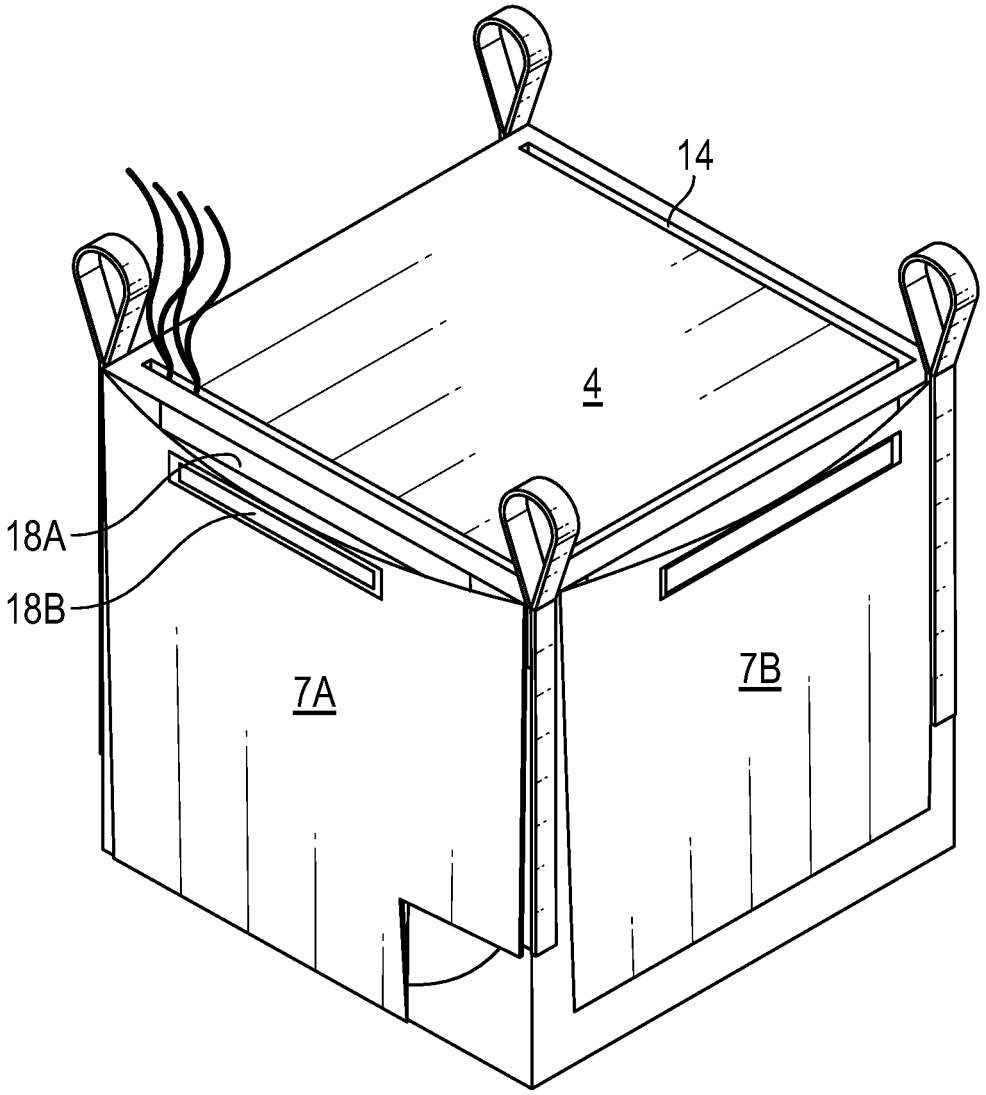
FIG. 4 illustrates a fourth embodiment of the container with the top panel closed.

The Figures also illustrate how containment bag 1 will include a pocket panel 7 attached to the sidewall panels 3 in a manner to form a pocket 8 with the sidewall panels 3. The pocket panels seen in FIGS. 1 to 4 are attached (for example by sewing) to sidewall panels 3 along the bottom and two sides of the sidewall panels, thereby leaving a pocket mouth 9 along the top of the sidewall panel. The pocket mouth 9 allows access to the interior space between pocket panel 7 and sidewall panel 3. In the illustrated embodiments, the pocket mouths 9 have a mouth closure 10. The mouth closures 10 will typically be zippers such as shown in FIGS. 1 and 2 (e.g., #3 or #4 coil zippers), but FIGS. 3 and 4 show hook and loop (e.g., Velcro®) mouth closures halves 18A and 18B. Suitable zippers could include coiled type or molded type formed of a metal or plastic. Mouth closures 10 could further be any conventional or future developed closure mechanism (e.g., snap fasteners or buttons engaging corresponding button holes). There could also be embodiments where the pockets are formed without mouth openings 9, e.g., the pocket panels are sewn to the sidewall panel along all four sides of the sidewall panel (as discussed further below).

FIG. 1 suggests how spring stiffeners 30 will be positioned in each pocket 8. The spring stiffeners 30 may be constructed out of any material and be of any shape which exerts force on at least three sides of the pockets 8. In a preferred embodiment of FIG. 1, the spring stiffener 30 is a spring steel loop 31 formed from a material such as oil tempered MB spring wire, class 1 with a temper regular mill finish. The spring steel loop 31 could be a rod with a circular cross-section diameter between about 0.075 and about 0.175 inches with its ends joined together by any conventional fastener or by welding. The spring steel loop could have other cross-sectional shapes such as square or rectangular, with a cross-sectional area between about 0.004 $in^2$ and about 0.024 $in^2$ in selected embodiments, and between about 0.003 $in^2$ and about 0.05 $in^2$ (or any sub-range in between) in other embodiments.

In many embodiments, the circumference "c" of the spring steel loop is between about 75% and about 95% of the perimeter length of the sidewalls 3. In the case of circular loops, the loop will have a corresponding diameter "d." In other embodiments, the circumference of the spring stiffener may be any percentage between 60% and 110% of the sidewall perimeter. This generally allows the spring steel loop 31 to be completely inserted into the pockets 8, while forcing the steel loop to deform somewhat and cause a greater percentage of the loop circumference to press against the interior sides of the pockets 8. Although it is typically preferable for spring steel loop 31 to be circular, this does not exclude the use of a loop which is non-circular or that the ends of the loop need be connected, i.e., a spring steel rod or wire segment could be bent in the shape of a loop and then enclosed in the pocket without the ends of the rod necessarily being connected back upon one another. Although there could be embodiments where the spring steel loop is connected to (e.g., sewn directly to) either of the interior walls of the pocket, in preferred embodiments, the spring steel loop is not connected to the sidewall panels or pocket panels, but is simply retained by the closed sides of the pockets.

Figure 5:
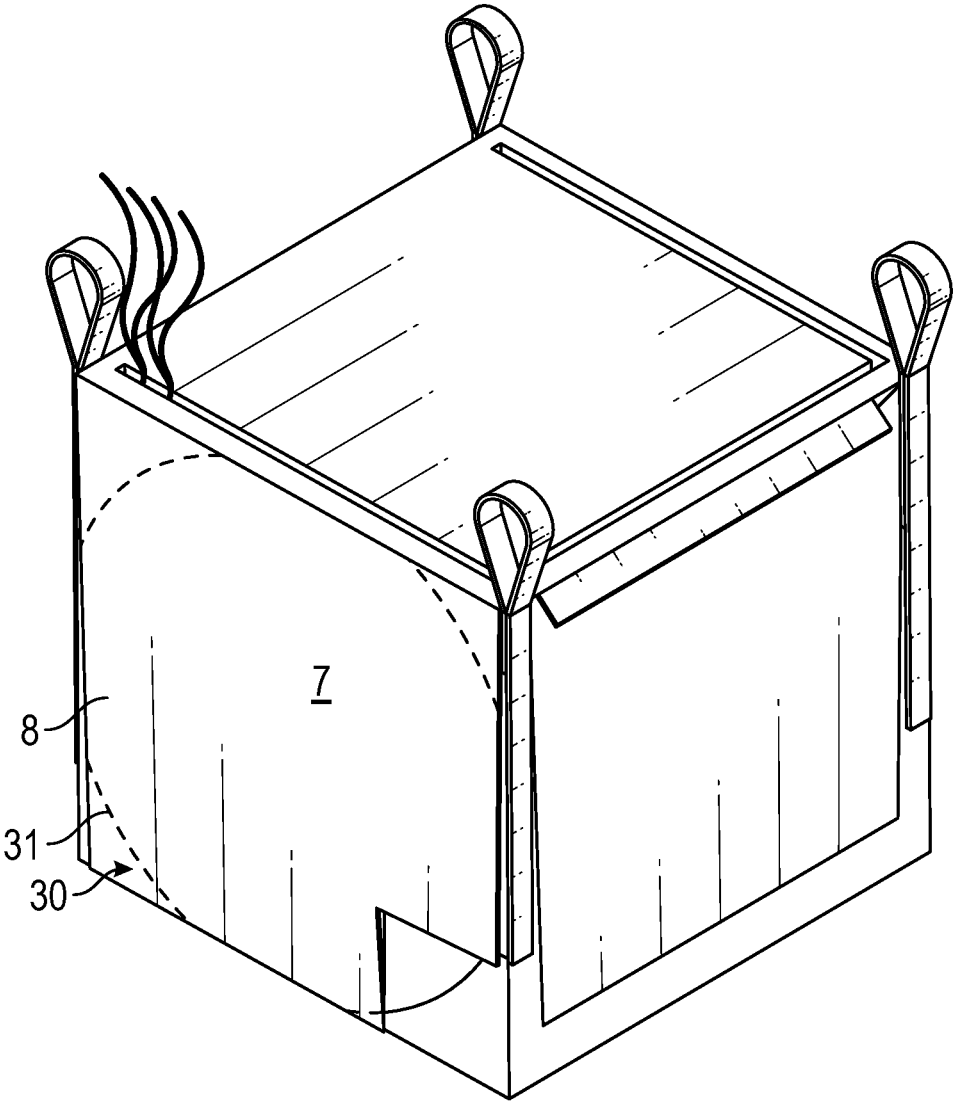
FIG. 5 illustrates a fifth embodiment of the container with the top panel closed.

As referenced above and suggested in in FIG. 5, the pockets 8 could be formed without pocket mouths 9. In such embodiments, the spring stiffeners 30 would be positioned between the sidewall panels and pocket panels, and then the pocket panels sewn along all sides to the sidewall panels (i.e., the perimeter of the pocket), thus "permanently" fixing the spring stiffeners within the pockets. FIG. 5 shows the pocket panels 7 on the outer surface of the sidewall panels, but pocket panels 7 could also be on the inside surface of the sidewalls. Nor is it necessary that the pocket panels be continuously sewn to the sidewall panel continuously along the entire perimeter of the pocket panel. The basic concept of the FIG. 5 embodiment is that the pocket panels are attached to the sidewall panels along a sufficient portion of the perimeter of the pocket panel (e.g., at non-continuous, spaced intervals) such that no gap remains sufficiently large to form a pocket mouth for insertion of the spring steel stiffener.

FIG. 1 further suggests how certain embodiments of containment bag 1 may include a series of lifting straps 40 having strap loops 41 which are sewn onto at least two sidewalls 3 (with the Figures showing two lifting straps on each of two opposing sidewalls). The free ends of the lifting straps will typically be formed into lifting loops. In preferred embodiments, the lifting straps are formed of a high tensile strength material such as woven nylon, but could also be polypropylene (e.g., 3" polypropylene webbing), polyester, or another material. Although the lifting straps 40 seen in the Figures are sewn to the bag's sidewalls, other embodiments could employ lifting straps in a "sling" configuration. In the sling configuration, the straps would extend continuously under the bottom of the bag. See for example, U.S. Pat. No. 9,493,299, which is incorporated by reference in its entirety.

While FIGS. 1 and 3 show the pocket panels 7 formed on the inside surface of sidewalls 3, FIGS. 2 and 4 show the pocket panels 7 formed on the outside surface of sidewalls 3. FIGS. 1 and 2 illustrate zippers closing the pocket mouths, while FIGS. 3 and 4 show Velcro® closures for the pocket mouths.

It can be seen how the structure of containment bag 1 allows for storage and shipping of the bags in a highly efficient manner. The bags may be folded into a highly compact form even with the spring stiffeners in the sidewall pockets. By moving the adjacent sidewall panels into substantial contact with one another (i.e., moving two opposing corners into contact), there is formed a flattened configuration of the self-standing bag. The tops and bottoms of the bags can be folded over the flattened sidewalls, or left extending beyond the sidewalls if the bags are stored on a surface with sufficient area. Because the spring stiffener loops take up so little volume, the containment bags 1 can be stacked very efficiently one on top of another. As one example, when stacking prior art self-standing bags having conventional cardboard stiffeners for storage and transport in a transport container, approximately 3 to 5 times as many containment bags 1 can be positioned in the same transport container as can the prior art self-standing containers.

There could also be embodiments where the spring stiffeners are fixed to the sidewall panels of the bag without necessarily being completely (or even partially) enclosed by a pocket panel. For example, retaining loops could be formed roughly around the perimeter of the bag sidewall and a spring stiffening rod threaded through the loops before the ends of the rod are joined together or overlapped. Alternatively, a circular spring stiffener could be attached at discrete points (e.g., by sewing) to the sidewall panel along the circumference of the spring stiffener.

The term "about" will typically mean a numerical value which is approximate and whose small variation would not significantly affect the practice of the disclosed embodiments. Where a numerical limitation is used, unless indicated otherwise by the context, "about" means the numerical value can vary by +/−5%, +/−10%, or in certain embodiments +/−15%, or even possibly as much as +/−20%. Similarly, "substantially" will typically mean at least 85% to 99% of the characteristic modified by the term. For example, "substantially all" will mean at least 85%, at least 90%, or at least 95%, etc.

The invention claimed is:

1. A self-standing container comprising:

(a) four sidewall panels, a bottom panel, and an openable top panel, wherein (i) all the panels are formed of a polymer material, (ii) the top panel has a closure configured to close the top panel in relation to the sidewall panels, and (iii) the sidewall, bottom, and top panels are formed from at least one of the materials from the group consisting of WPP, WPE, PVC, Urethane, NWPP, NWPET, Ctd NWPP, and Ctd NWPET;

(b) each sidewall panel having a pocket panel attached thereto forming a pocket; and (c) a spring steel stiffener positioned between each sidewall and pocket panel, wherein (i) the sidewalls have a perimeter, the spring steel stiffener has a circumference, and the circumference is 75% to 95% of the perimeter, and (ii) the spring steel stiffener is formed of wire which has a cross-sectional area of between 0.0044 $in^2$ and 0.0241 $in^2$ and which is formed into a closed loop.

2. The self-standing container of claim 1, wherein, the pockets include (i) a pocket mouth opening toward the top panel, and (ii) a mouth closure configured to close the pocket mouth.

3. The self-standing container of claim 1, wherein the pocket panels are attached to the sidewall panels along a sufficient portion of a perimeter of the pocket panel such no pocket mouth remains for insertion of the spring steel stiffener.

4. The self-standing container of claim 1, wherein the sidewall panel material has a weight of between 5 and 20 $oz/yd^2$.

5. The self-standing container of claim 2, wherein the mouth closures include hook and loop sections.

6. A self-standing container comprising:

(a) at least one sidewall panel and an openable top panel, the top panel having a closure configured to close the top panel in relation to the sidewall panel;

(b) the sidewall panel having a pocket panel attached thereto in a manner to form a pocket with the sidewall panel; and c) a spring stiffener positioned between the sidewall and pocket panel, the spring stiffener configured to place force against multiple sides of the pocket.

7. The self-standing container of claim 6, wherein the spring stiffener is a steel stiffener forming a loop within the pocket.

8. The self-standing container of claim 6, wherein the pocket includes a pocket mouth opening toward the top panels and a mouth closure configured to close the pocket mouth.

9. The self-standing container of claim 8, wherein the mouth closure comprises at least one of either zippers or Velcro segments.

10. The self-standing container of claim 6, wherein the pocket panel is permanently attached to the sidewall panel along all sides of the pocket panel.

11. The self-standing container of claim 10, wherein the pocket panel is sewn to the sidewall panel along substantially an entire perimeter of the pocket panel.

12. The self-standing container of claim 6, wherein the pocket panel has no closeable opening.

13. The self-standing container of claim 6, wherein the stiffener is formed of wire which is between 0.075 and 0.175 inches in diameter.

14. The self-standing container of claim 6, wherein the stiffener is formed of wire which has a cross-sectional area of between 0.0044 $in^2$ and 0.0241 $in^2$.

15. The self-standing container of claim 6, wherein the self-standing container has four sidewalls.

16. The self-standing container of claim 8, wherein the mouth closure is a zipper.

17. The self-standing container of claim 16, wherein the zipper is coiled type or molded type.

18. The self-standing container of claim 6, wherein the sidewall and top panels are formed from at least one of the materials from the group consisting of WPP, WPE, PVC, Urethane, NWPP, NWPET, Ctd NWPP, and Ctd NWPET.

19. The self-standing container of claim 18, wherein the sidewall panel material has a weight of between 5 and 20 $oz/yd^2$.

* * * * *